US005353086A

United States Patent [19]

Piccinino, Jr. et al.

[11] Patent Number: 5,353,086

[45] Date of Patent: Oct. 4, 1994

[54] TEXTURED SURFACE WITH CANTED CHANNELS FOR AN AUTOMATIC TRAY PROCESSOR

[75] Inventors: Ralph L. Piccinino, Jr., Rush; John H. Rosenburgh, Hilton; David L. Patton, Webster; Joseph A. Manico, Rochester, all of N.Y.

[73] Assignee: Eastman Kodak Company, Rochester, N.Y.

[21] Appl. No.: 56,451

[22] Filed: May 3, 1993

[51] Int. Cl.[5] ..... G03D 3/02

[52] U.S. Cl. ..... 354/324; 354/331; 354/336

[58] Field of Search ..... 354/318–324, 354/331, 336; 134/64 R, 64 P, 122 R, 122 P

[56] References Cited

U.S. PATENT DOCUMENTS

| | | | |
|---|---|---|---|
| 3,641,911 | 2/1972 | Aelterman et al. | 95/94 |
| 3,683,780 | 8/1972 | Edelman et al. | 95/94 |
| 3,685,420 | 8/1972 | Stievenart et al. | 95/89 |
| 3,733,992 | 5/1973 | Stievenart et al. | 354/324 |
| 3,744,394 | 7/1973 | Firth | 95/89 |
| 4,101,919 | 8/1978 | Ammann | 354/319 |
| 4,119,990 | 10/1978 | Mason et al. | 354/317 |
| 4,419,434 | 12/1983 | Molaire et al. | 430/207 |
| 4,490,030 | 12/1984 | Acklin et al. | 354/322 |
| 4,647,173 | 3/1987 | Schar | 354/319 |
| 4,737,810 | 4/1988 | Kobayashi et al. | 354/299 |
| 4,794,415 | 12/1988 | Larsen | 354/302 |
| 4,928,717 | 5/1990 | Osarek et al. | 134/64 |
| 4,987,438 | 1/1991 | Goto et al. | 354/319 |
| 5,179,404 | 1/1993 | Bartell et al. | 354/320 |

*Primary Examiner*—D. Rutledge
*Attorney, Agent, or Firm*—Frank Pincelli

[57] ABSTRACT

The processing channel contains textured surfaces with canted passageways to reduce frictional forces and adhering between the photographic material and the contacting surfaces of the processing channel.

12 Claims, 6 Drawing Sheets

TEXTURED SURFACE WITH CANTED CHANNELS FOR AN AUTOMATIC TRAY PROCESSOR

CROSS REFERENCE TO RELATED APPLICATIONS

Reference is made to commonly assigned copending patent applications Ser. No. 08/057,250, filed May 3, 1993, [(our Docket No. 64,590)] entitled "AUTOMATIC TRAY PROCESSOR" [filed herewith] in the names of John H. Rosenburgh, Joseph A. Manico, David L. Patton and Ralph L. Piccinino, Jr., and Ser. No. 08/056,458, filed May 3, 1993, [(our Docket No. 65,369)] entitled "MODULAR PROCESSING CHANNEL FOR AN AUTOMATIC TRAY PROCESSOR" [filed herewith] in the names of Joseph A. Manico, Ralph L. Piccinino, Jr., David L. Patton and John H. Rosenburgh, and Ser. No. 08/056,477, filed May 3, 1993, [(our Docket No. 65,373)] entitled "COUNTER CROSS FLOW FOR AN AUTOMATIC TRAY PROCESSOR" [filed herewith] in the names of John H. Rosenburgh, Ralph L. Piccinino, Jr., David L. Patton and Joseph A. Manico, and Ser. No. 8/057,131, filed May 3, 1993, [(our Docket 65,376)] entitled "VERTICAL AND HORIZONTAL POSITIONING AND COUPLING OF AUTOMATIC TRAY PROCESSOR CELLS" [filed herewith] in the names of David L. Patton, Joseph A. Manico, John H. Rosenburgh and Ralph L. Piccinino, Jr., and Ser. No. 08/056,730, filed May 3, 1993, [(our Docket No. 65,393)] entitled "AUTOMATIC REPLENISHMENT, CALIBRATION AND METERING SYSTEM FOR AN AUTOMATIC TRAY PROCESSOR" [filed herewith] in the names of John H. Rosenburgh, Robert L. Horton[,] and David L. Patton [and Ralph L. Piccinino, Jr.], and Ser. No. 08/056,457, filed May 3, 1993, [(our Docket No. 65,429)] entitled "CLOSED SOLUTION RECIRCULATION/SHUT-OFF SYSTEM FOR AN AUTOMATIC TRAY PROCESSOR" [filed herewith] in the names of John H. Rosenburgh, Joseph A. Manico, Ralph L. Piccinino, Jr. and David L. Patton, and Ser. No. 08/056,649, filed May 3, 1993, [(our Docket No. 65,602)] entitled "A SLOT IMPINGEMENT FOR AN AUTOMATIC TRAY PROCESSOR" [filed herewith] in the names of John H. Rosenburgh, David L. Patton, Joseph A. Manico and Ralph L. Piccinino, Jr., and Ser. No. 08/056,455, filed May 3, 1993, [(our Docket No. 67,422)] entitled "AUTOMATIC REPLENISHMENT, CALIBRATION AND METERING SYSTEM FOR A PHOTOGRAPHIC PROCESSING APPARATUS" [filed herewith] in the names of John H. Rosenburgh, Robert L. Horton[,] and David L. Patton [and Ralph L. Piccinino, Jr.].

FIELD OF THE INVENTION

The invention relates to the field of photography, and particularly to a photosensitive material processing apparatus.

BACKGROUND OF THE INVENTION

The processing of photosensitive material involves a series of steps such as developing, bleaching, fixing, washing, and drying. With the development step being the most critical and sensitive to variations induced by time, temperature, agitation and chemical activity. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 liters of each processing solution. A small photofinishing apparatus or microlab utilizes tanks that may contain less than 10 liters of processing solution.

The chemicals contained in the processing solution: cost money to purchase; change in activity and are seasoned by constituents of the photosensitive materials that leach out during the photographic process; and after the chemicals are used the chemicals must be disposed of in an environmentally safe manner. Thus, it is important in all sizes of photofinishing apparatus to reduce the volume of processing solution. The prior art suggest various types of replenishing systems that add or subtract specific chemicals to the processing solution to maintain a consistency of photographic characteristics in the material developed. It is possible to maintain reasonable consistency of photographic characteristics only for a certain period of replenishment. After a processing solution has been used a given number of times, the solution is discarded and a new processing solution is added to the tank.

Activity degradation due to instability of the chemistry, or chemical contamination, after the components of the processing solution are mixed together causes one to discard the processing solution in smaller volume tanks more frequently than larger volume tanks. Some of the steps in the photographic process utilize processing solutions that contain chemicals that are unstable, i.e., they have a short process life. Thus, processing solutions in tanks that contain unstable chemicals are discarded more frequently than processing solutions in tanks that contain stable chemicals.

Textured surfaces have been used to facilitate photosensitive material directional changes in or out of the processing solution. They have also been used to create a solution bearing layer for photosensitive material to be moved over the textured surface.

The prior art used automatic photoprocessing equipment to process photosensitive material. Automatic photoprocessing equipment typically is configured as a sequential arrangement of transport racks submerged in tanks filled with volumes of processing solutions. The textured surface was affixed to the vertically oriented racks and/or tanks. In the above type of configuration when the tank was drained the processing solution fell vertically out of the textured surface and the tank without pooling any processing solution. This also prevented the processing solution from becoming entrapped in the textured surface. In a horizontal processor, there will not be a natural vertical flow of the processing solution.

PROBLEMS TO BE SOLVED BY THE INVENTION

If a rack and tank processor were no longer used and one attempted to place a textured surface in a horizontal processor the processing solution would not fall vertically out of the textured surface. The processing solution would pool within the crevices of the textured surface and processing solution along with debris and contaminants would be entrapped within the textured surface.

SUMMARY OF THE INVENTION

This invention overcomes the disadvantages of the prior art by providing a horizontal low volume photographic material processing apparatus that introduces fresh processing solution uniformly across the surfaces of a photosensitive material. Textured surfaces with canted passageways are utilized to reduce frictional forces and adhering between the photosensitive material and the contacting surfaces of the processing channel. This also provides the processing channel with complete drainage of the horizontal bottom transport surface while continuing to provide a fluid bearing between the photosensitive material surface and the textured surface. In addition the textured surface increases processing solution agitation while providing a passageway for the removal of processing contaminants and debris.

ADVANTAGEOUS EFFECT OF THE INVENTION

The above textured surface prevents the photosensitive material from sticking to the surfaces of the processing channel due to surface tension. The textured surface also aids in uniform distribution of processing solution across the photosensitive material enhancing process uniformity and solution agitation.

The textured surface allows the photosensitive material to easily change direction in a small space. The canting of the passageways of the textured surface allows the photosensitive material to follow the straight horizontal path while the processing solution follows a different path and is directed away from the transported photosensitive material. The small passageways permits the reduction in processing solution volume and prevents the catching edges of the photosensitive material.

This invention overcomes the disadvantages of the prior art by providing an apparatus for processing photosensitive materials, which comprises: a container which contains a channel through which a processing solution flows, the entrance and exit of the channel are upturned to contain processing solution within the channel and the inner surfaces of the channel are textured to facilitate transport of photosensitive materials and processing solution distribution and agitation; means coupled to the channel for transporting the photosensitive material from the channel entrance, through the channel, to the channel exit, the channel and the means are relatively dimensioned so that a small volume for holding processing solution and photosensitive material is formed between the channel and the means; and means for circulating the processing solution through the small volume and the container.

DESCRIPTION OF THE PREFERRED EMBODIMENT

Figure 1:
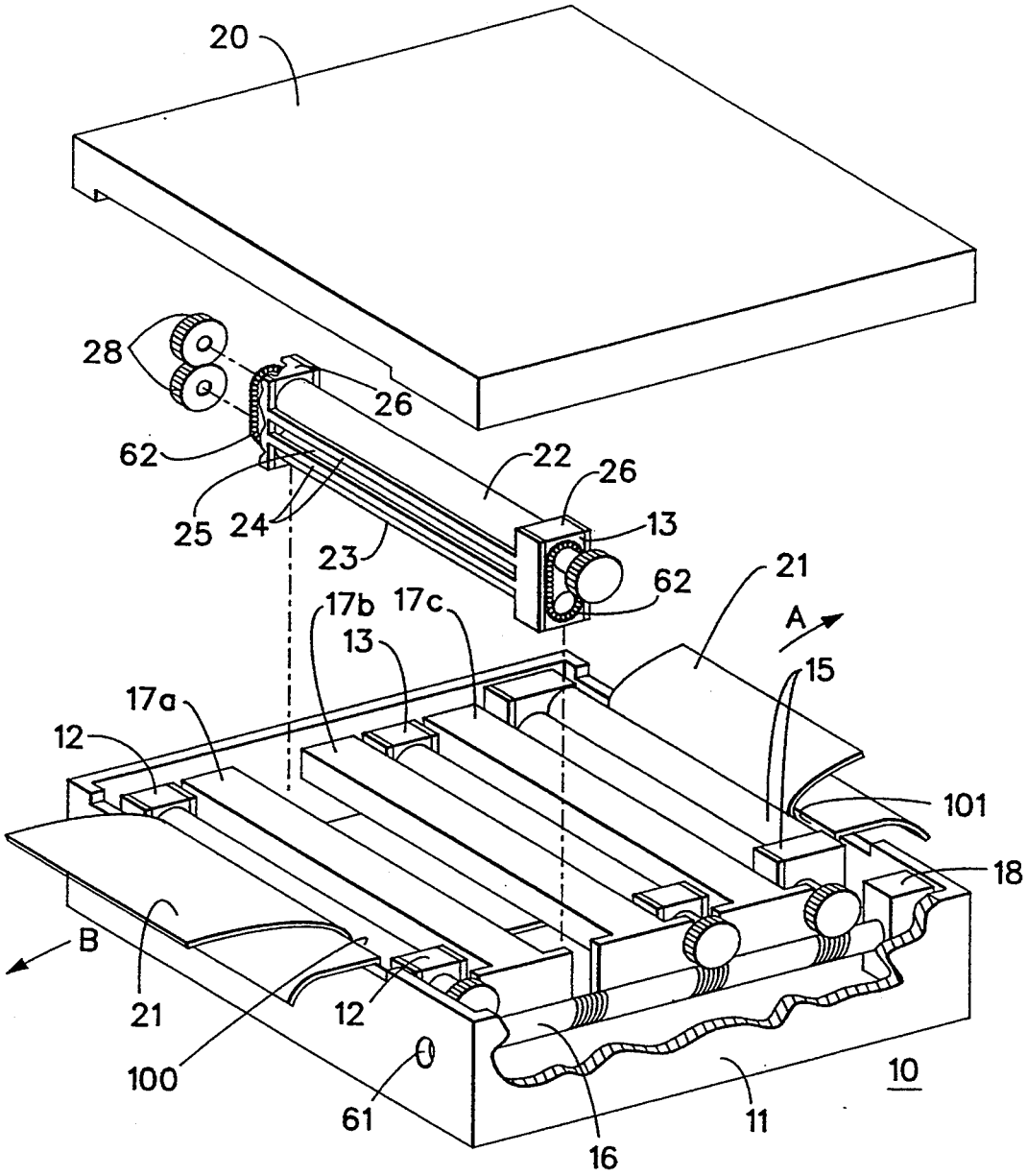
FIG. 1 is a perspective drawing of module 10.

Referring now to the drawings in detail, and more particularly to FIG. 1, the reference character 10 represents a processing module, which may stand alone or be easily combined or adjoined with other processing modules 10 to form a continuous low volume unit for processing photosensitive materials.

Processing module 10 includes: a container 11; an upturned entrance channel 100 (described in the description of FIG. 2); an entry transport roller assembly 12; transport roller assemblies 13; an exit transport roller assembly 15; an upturned exit channel 101 (described in the description of FIG. 2); high impingement slot nozzles 17*a*, 17*b* and 17*c*; a drive 16 and a rotating assembly 18, assembly 18 may be any known means for turning drive 16, i.e., a motor, a gear, a belt, a chain, etc. An access hole 61 is provided in container 11. Hole 61 is utilized for the interconnection of modules 10. Assemblies 12, 13 and 15 are positioned within container 11 in the vicinity of the walls of container 11 and slot nozzles 17*a*, 17*b* and 17*c* are positioned within the vicinity of the walls of container 11. Drive 16 is connected to roller assemblies 12, 13 and 15 and turning assembly 18 and assembly 16 is used to transmit the motion of assembly 18 to assemblies 12, 13 and 15.

Roller assemblies 12, 13, and 15, and slot nozzles 17*a*, 17*b* and 17*c* may be easily inserted into or removed from container 11. Roller assembly 13 includes: a top roller 22; a bottom roller 23; tension springs 62, which holds top roller 22 in compression with respect to bottom roller 23; a bearing bracket 26; and a channel section 24. A narrow channel opening 25 exists within section 24. Opening 25 on the entrance side of section 24 may be the same size and shape as opening 25 on the exit side of section 24. Opening 25 on the entrance side of section 24 may also be relieved, tapered or larger than the exit side of section 24 to accommodate rigidity variations of various types of photosensitive material 21. Channel opening 25 forms a portion of processing channel 25. Rollers 22 and 23 may be drive or driven rollers and rollers 22 and 23 are connected to bracket 26. Rollers 22 and 23 are rotated by intermeshing gears 28.

Photosensitive material 21 is transported in either direction A or direction B automatically through processing channel 25 by roller assemblies 12, 13 and 15. Photosensitive material 21 may be in a cut sheet or roll format or photosensitive material 21 may be simultaneously in a roll and simultaneously in a cut sheet format. Photosensitive material 21 may contain an emulsion on either or both of its surfaces.

When cover 20 is placed on container 11 a light tight enclosure is formed. Thus, module 10 with its associated recirculation system 60, which is described in the description of FIG. 5, will be a stand alone light tight module that is capable of processing photosensitive material, i.e., a monobath. When two or more modules 10 are combined a multi-stage continuous processing unit may be formed. The combination of one or more modules 10 will be more fully set forth in the description of FIG. 6.

Figure 2:
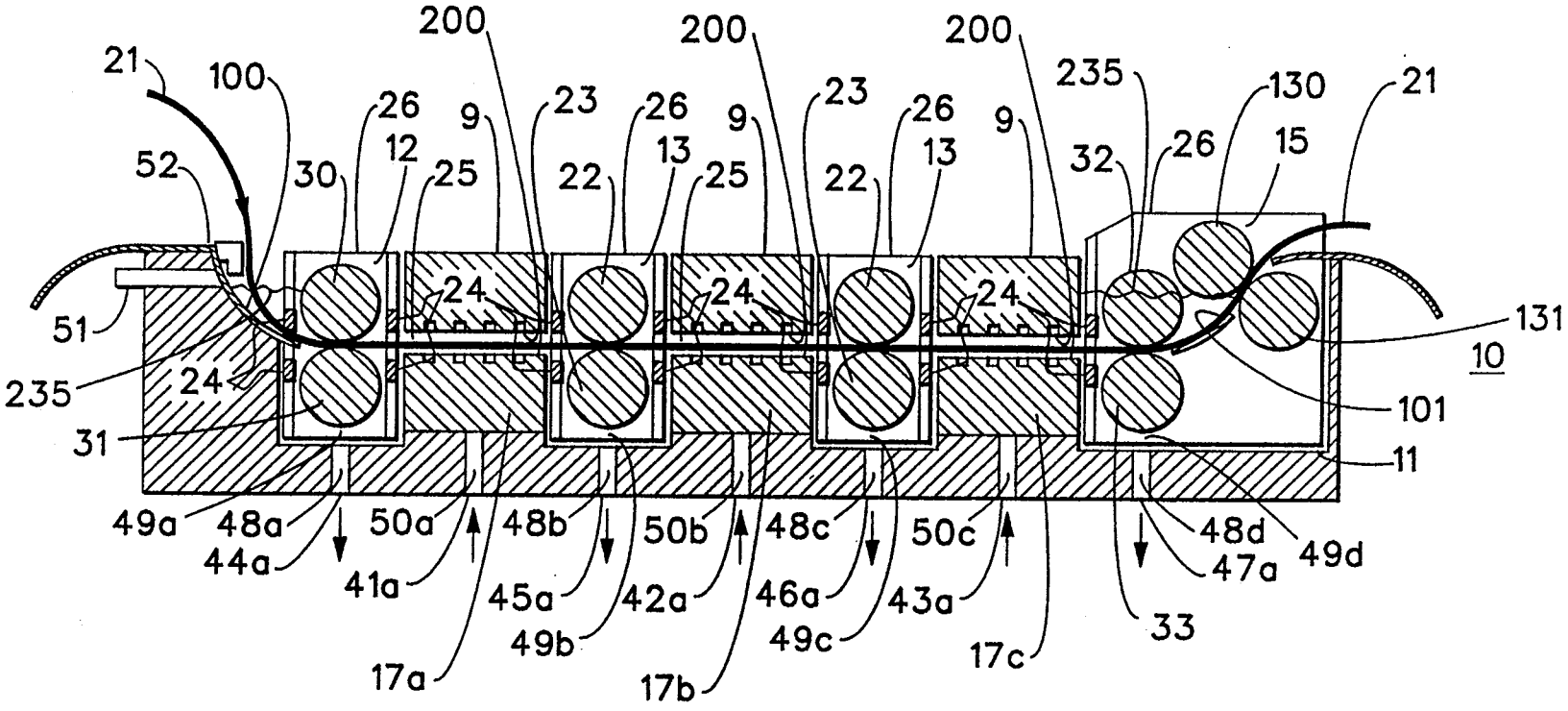
FIG. 2 is a partially cut away drawing of module 10 in which material 21 has an emulsion on one surface and nozzles 17*a*, 17*b* and 17*c* are on the bottom portion of container 11 facing the emulsion surface of material 21.

FIG. 2 is a partially cut away section of module 10 of FIG. 1. Assemblies 12, 13 and 15, nozzles 17*a*, 17*b* and 17*c* and backing plate 9 are designed in a manner to minimize the amount of processing solution that is contained in processing channel 25, vessel 11, recirculation system 60 (FIG. 5) and gaps 49*a*, 49*b*, 49*c* and 49*d*. At the entrance of module 10, an upturned channel 100 forms the entrance to processing channel 25. At the exit of module 10, an upturned channel 101 forms the exit to processing channel 25. Assembly 12 is similar to assembly 13. Assembly 12 includes: a top roller 30; a bottom roller 31; tension springs 62 (not shown) which holds top roller 30 to bottom roller 31; a bearing bracket 26; and a channel section 24. A portion of narrow processing channel 25 is formed by channel section 24. Rollers 30 and 31 may be drive or driven rollers and rollers 30 and 31 are connected to bracket 26. Assembly 15 is similar to assembly 13, except that assembly 15 has an additional two rollers 130 and 131, which operate in the same manner as rollers 32 and 33. Assembly 15 includes: a top roller 32; a bottom roller 33; tension springs 62 (not shown); a top roller 130; a bottom roller 131; a bearing bracket 26; a channel section 24. A portion of narrow processing channel 25 exists within section 24. Channel section 24 forms a portion of processing channel 25. Rollers 32, 33, 130 and 131 may be drive or driven rollers and rollers 32, 33, 130 and 131 are connected to bracket 26.

Backing plate 9 and slot nozzles 17*a*, 17*b* and 17*c* are affixed to container 11. The embodiment shown in FIG. 2 will be used when photosensitive material 21 has an emulsion on one of its surfaces. The emulsion side of material 21 will face slot nozzles 17*a*, 17*b* and 17*c*. Material 21 enters channel 25 between rollers 30 and 31 and moves past backing plate 9 and nozzle 17*a*. Then material 21 moves between rollers 22 and 23 and moves past backing plates 9 and nozzles 17*b* and 17*c*. At this point material 21 will move between rollers 32 and 33, and move between rollers 130 and 131 and exit processing channel 25.

Figure 5:
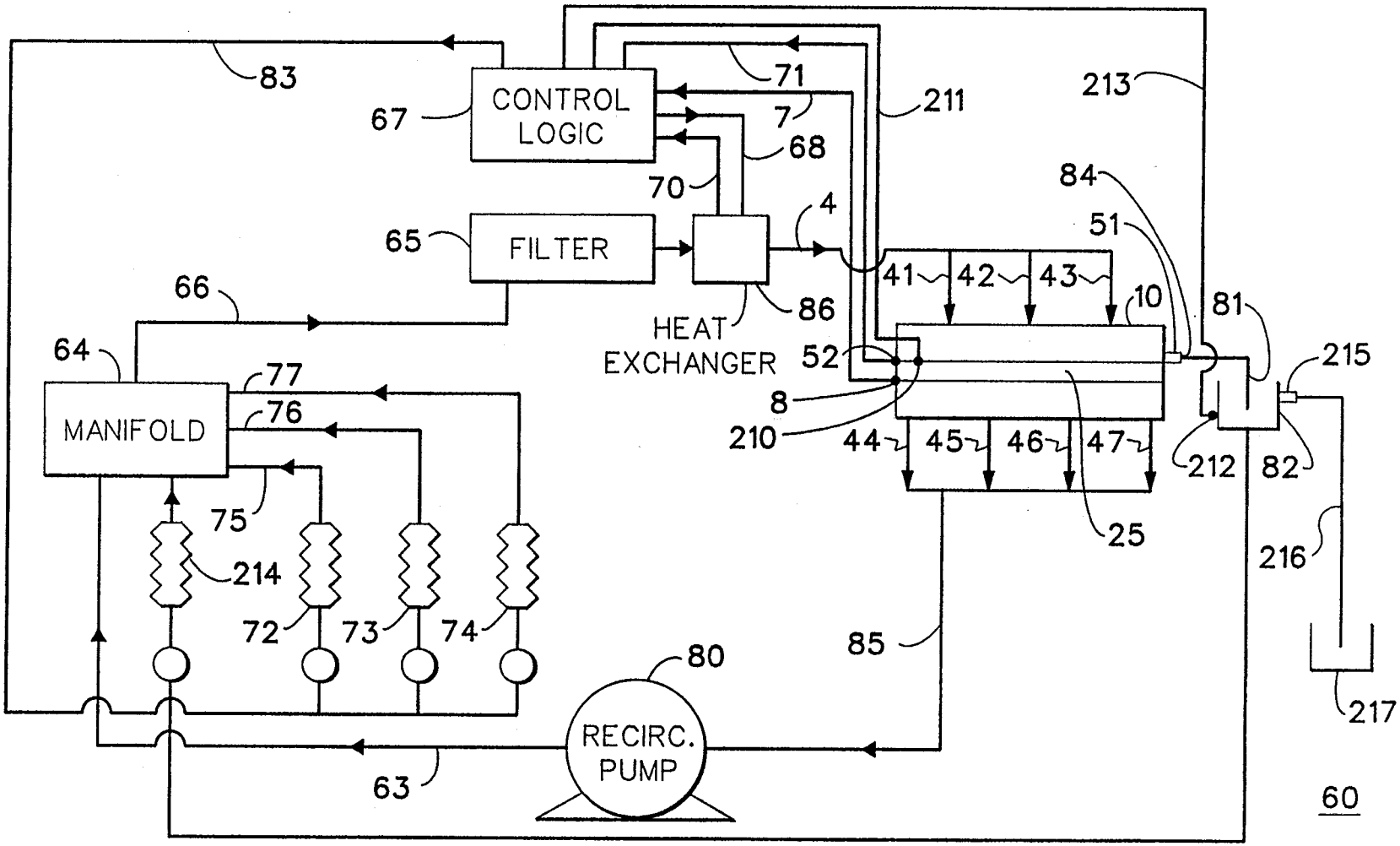
FIG. 5 is a schematic drawing of the processing solution recirculation system of the apparatus of this invention.

Conduit 48*a* connects gap 49*a*, via port 44*a* to recirculation system 60 via port 44 (FIG. 5), which is more fully described in the description of FIG. 5, and conduit 48*b* connects gap 49*b*, via port 45*a* to recirculation system 60 via port 45 (FIG. 5). Conduit 48*c* connects gap 49*c*, via port 46*a* to recirculation system 60 via port 46 (FIG. 5) and conduit 48*d* connects gap 49*d*, via port 47*a* to recirculation system 60 via port 47 (FIG. 5). Slot nozzle 17*a* is connected to recirculation system 60 via conduit 50*a* and inlet port 41*a* via port 44 (FIG. 5) and slot nozzle 17*b* is connected to recirculation system 60 via conduit 50*b* and inlet port 42*a* via inlet port 42 (FIG. 5). Conduit 50*c* connects nozzle 17*c*, via inlet port 43*a* to recirculation system 60 via port 43 (FIG. 5). Sensor 52 is connected to container 11 and sensor 52 is used to maintain a processing solution level 235 relative to conduit 51. Excess processing solution may be removed by overflow conduit 51.

Textured surface 200 or 205 is affixed to the surface of backing plate 9 that faces processing channel 25 and to the surface of slot nozzles 17*a*, 17*b* and 17*c* that faces processing channel 25.

Figure 3:
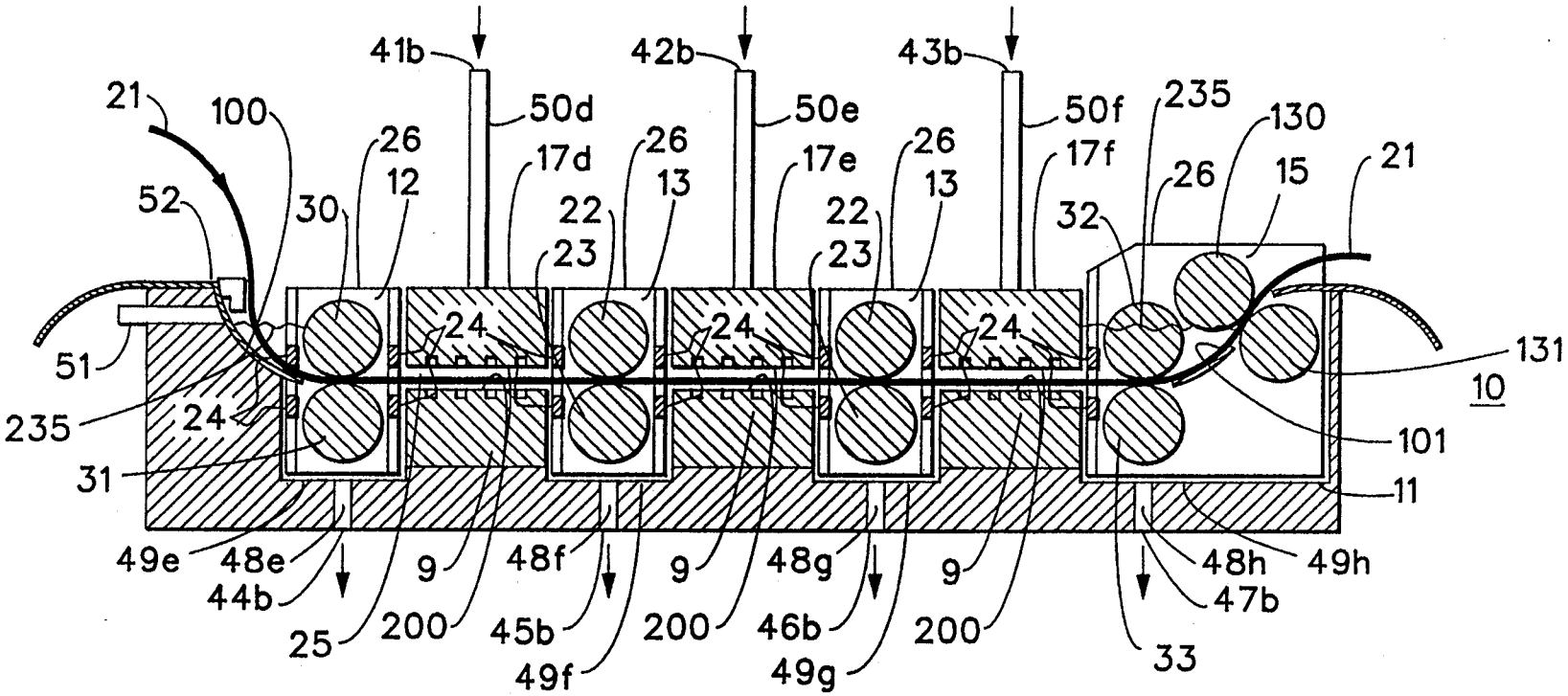
FIG. 3 is a partially cut away drawing of an alternate embodiment of module 10 of FIG. 2 in which material 21 has an emulsion on one surface and nozzles 17*d*, 17*e* and 17*f* are on the top portion of container 11 facing the emulsion surface of material 21.

FIG. 3 is a partially cut away drawing of an alternate embodiment of module 10 of FIG. 2 in which material 21 has an emulsion on one surface and nozzles 17*d*, 17*e* and 17*f* are on the top portion of container 11. Assemblies 12, 13 and 15, nozzles 17*d*, 17*e* and 17*f* and backing plate 9 are designed in a manner to minimize the amount of processing solution that is contained in processing channel 25 and gaps 49*e*, 49*f*, 49*g* and 49*h*. At the entrance of module 10, an upturned channel 100 forms the entrance to processing channel 25. At the exit of module 10, an upturned channel 101 forms the exit to processing channel 25. Assembly 12 is similar to assembly 13. Assembly 12 includes: a top roller 30; a bottom roller 31; tension springs 62 (not shown) which holds top roller 30 in compression with respect to bottom roller 31, a bearing bracket 26; and a channel section 24. A portion of narrow channel opening 25 exists within section 24. Channel section 24 forms a portion of processing channel 25. Rollers 30 and 31 may be drive or driven rollers and rollers 30 and 31 are connected to bracket 26. Assembly 15 is similar to assembly 13, except that assembly 15 has an additional two rollers 130 and 131 that operate in the same manner as rollers 32 and 33. Assembly 15 includes: a top roller 32; a bottom roller 33; a tension spring 62 (not shown); a top roller 130; a bottom roller 131; a bearing bracket 26; and a channel section 24. A portion of narrow processing channel 25 exits within section 24. Channel section 24 forms a portion of processing channel 25. Rollers 32, 33, 130 and 131 may be drive or driven rollers and rollers 32, 33, 130 and 131 are connected to bracket 26.

Backing plate 9 and slot nozzles 17*d*, 17*e* and 17*f* are affixed to container 11. The embodiment shown in FIG. 3 will be used when photosensitive material 21 has an emulsion on one of its surfaces. The emulsion side of material 21 will face slot nozzles 17*d*, 17*e* and 17*f*. Material 21 enters channel 25 between rollers 30 and 31 and moves past backing plate 9 and nozzle 17*d*. Then material 21 moves between rollers 22 and 23 and moves past backing plates 9 and nozzles 17*e* and 17*f*. At this point material 21 will move between rollers 32 and 33 and move between rollers 130 and 131 and exit processing channel 25.

Conduit 48*e* connects gap 49*e*, via port 44*b* to recirculation system 60 via port 44 (FIG. 5) and conduit 48*f* connects gap 49*f*, via port 45*b* to recirculation system 60 via port 45 (FIG. 5). Conduit 48*g* connects gap 49*g*, via port 46*b* to recirculation system 60 via port 46 (FIG. 5) and conduit 48*h* connects gap 49*h*, via port 47*b* to recirculation system 60 via port 47 (FIG. 5). Slot nozzle 17*d* is connected to recirculation system 60 via conduit 50*d* and inlet port 41*b* via inlet 41 (FIG. 5) and slot nozzle 17*e* is connected to recirculation system 60 via conduit 50*e* and inlet port 42*b* via port 42 (FIG. 5). Conduit 50*f* connects nozzle 17*f*, via inlet port 43*b* to recirculation system 60 via port 43 (FIG. 5). Sensor 52 is connected to container 11 and sensor 52 is used to maintain a processing solution level 235 relative to conduit 51. Excess processing solution may be removed by overflow conduit 51.

Textured surface 200 or 205 is affixed to the surface of backing plate 9 that faces processing channel 25 and to the surface of slot nozzles 17*d*, 17*e* and 17*f* that faces processing channel 25.

Figure 4:
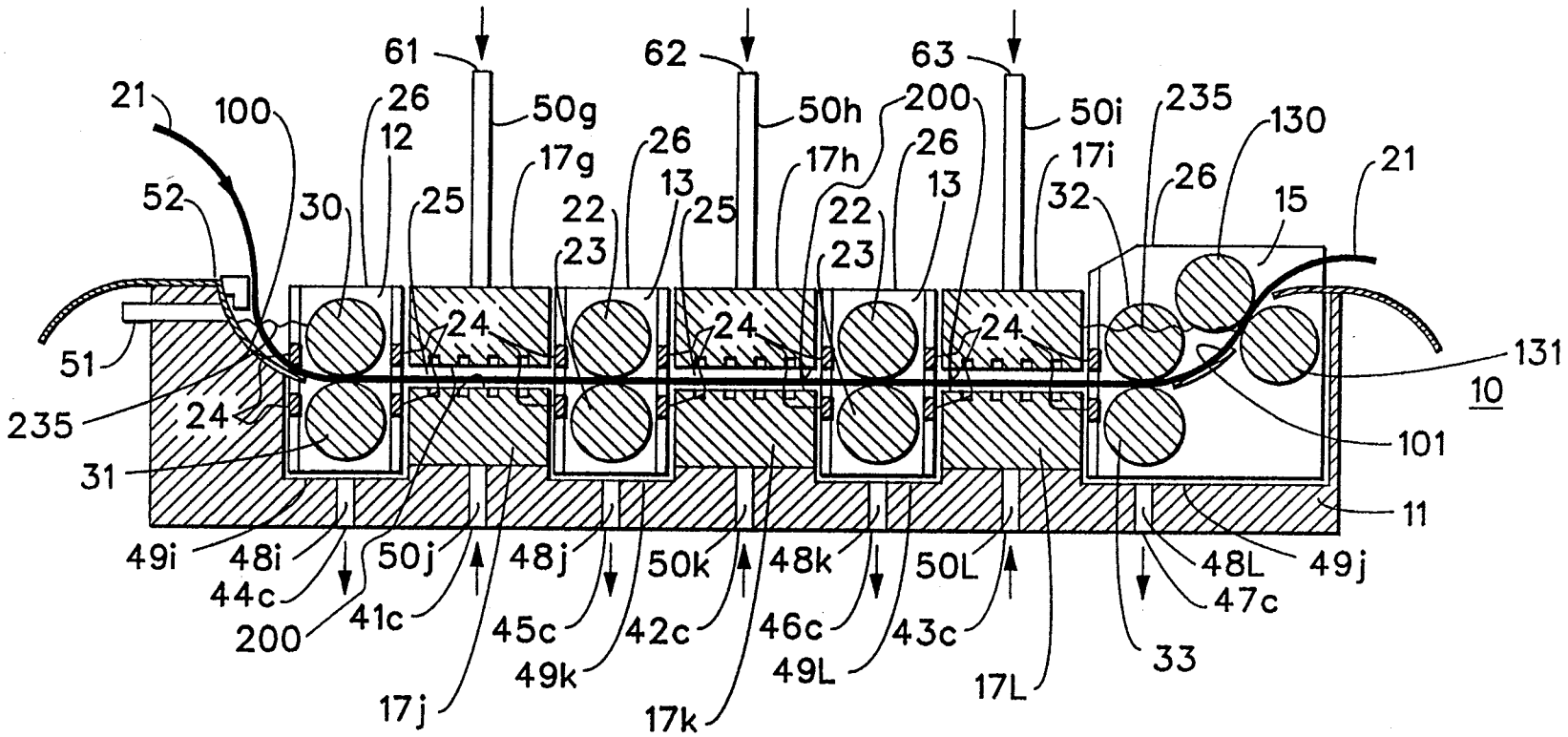
FIG. 4 is a partially cut away drawing of an alternate embodiment of module 10 of FIG. 2 in which material 21 has an emulsion on both surfaces and nozzles 17*g*, 17*h* and 17*i* are on the top portion of container 11 facing one emulsion surface of material 21 and nozzles 17*j*, 17*k*, and 17L are on the bottom portion of container 11 facing the other emulsion surface of material 21.

FIG. 4 is a partially cut away drawing of an alternate embodiment of module 10 of FIG. 2 in which material 21 has an emulsion on both surfaces and nozzles 17*g*, 17*h* and 17*i* are on the top portion of container 11 facing one emulsion surface of material 21 and nozzles 17*j*, 17*k*, and 17L are on the bottom portion of container 11 facing the other emulsion surface of material 21. Assemblies 12, 13 and 15, nozzles 17*g*, 17*h*, 17*i*, 17*j*, 17*k* and 17L are designed in a manner to minimize the amount of processing solution that is contained in processing channel 25 and gaps 49*i*, 49*j*, 49*k* and 49L. At the entrance of module 10, an upturned channel 100 forms the entrance to processing channel 25. At the exit of module 10, an upturned channel 101 forms the exit to processing channel 25. Assembly 12 includes: a top roller 30; a bottom roller 31; tension springs 62 (not shown) which holds top roller 30 in compression with respect to bottom roller 31, a bearing bracket 26; and a channel section 24. A portion of narrow processing channel 25 exists within section 24. Channel section 24 forms a portion of processing channel 25. Rollers 30, 31, 130 and 131 may be drive or driven rollers and rollers 30, 31, 130 and 131 are connected to bracket 26. Assembly 15 is similar to assembly 13, except that assembly 15 has an additional two rollers 130 and 131 which operate in the same manner as rollers 32 and 33. Assembly 15 includes: a top roller 32; a bottom roller 33; tension springs 62 (not shown); a top roller 130; a bottom roller 131; a bearing bracket 26; and a channel section 24. A portion of narrow processing channel 25 exists within section 24. Channel section 24 forms a portion of processing channel 25. Rollers 32, 33, 130 and 131 may be drive or driven rollers and rollers 32, 33, 130 and 131 are connected to bracket 26.

Slot nozzles 17*g*, 17*h* and 17*i* are affixed to the upper portion of container 11. Slot nozzles 17*j*, 17*k* and 17L are affixed to the lower portion of container 11. The embodiment shown in FIG. 4 will be used when photosensitive material 21 has an emulsion on both of its two surfaces. One emulsion side of material 21 will face slot nozzles 17*g*, 17*h* and 17*i* and the other emulsion side of material 21 will face slot nozzles 17*j*, 17*k* and 17L. Material 21 enters channel 25 between rollers 30 and 31 and moves past and nozzles 17*g* an 17*j*. Then material 21 moves between rollers 22 and 23 and moves past nozzles 17*h*, 17*k*, 17*i* and 17L. At this point material 21 will move between rollers 32 and 33 and move between rollers 130 and 131 and exit processing channel 25.

Conduit 48*i* connects gap 49*i*, via port 44*c* to recirculation system 60 via port 44 (FIG. 5) and conduit 48*j* connects gap 49*k*, via port 45*c* to recirculation system 60 via port 45 (FIG. 5). Conduit 48*k* connects gap 49L, via port 46*c* to recirculation system 60 and conduit 48L connects gap 49*j*, via port 47*c* to recirculation system 60 via port 47 (FIG. 5). Slot nozzle 17*g* is connected to recirculation system 60 via conduit 50*g* via port 41 (FIG. 5). Slot nozzle 17*h* is connected to recirculation system 60 via conduit 50*h* and inlet port 62 via port 42 (FIG. 5). Conduit 50*i* connects nozzle 17*i*, via inlet port 63 to recirculation system 60 via port 43 (FIG. 5). Slot nozzle 17*j* is connected to recirculation system 60 via conduit 50*j* and inlet port 41*c* via port 41 (FIG. 5) and slot nozzle 17*k* is connected to recirculation system 60 via conduit 50*k* and inlet port 42*c* via port 42 (FIG. 5). Slot nozzle 17L is connected to recirculation system 60 via conduit 50L and inlet port 43*c* via port 43 (FIG. 5). Sensor 52 is connected to container 11 and sensor 52 is used to maintain a level of processing solution relative to conduit 51. Excess processing solution may be removed by overflow conduit 51. Material 21 enters upturned channel entrance 100, then passes through channel section 24 of channel 25 between rollers 30 and 31 and moves past nozzles 17*g* and 17*j*. Then material 21 moves between rollers 22 and 23 and moves past nozzles 17*h* and 17*k*, 17L and 17*i*. At this point material 21 will move between rollers 32 and 33 and exit processing channel 25.

Conduit 48*i* connects gap 49*i*, via port 44*c* to recirculation system 60 via port 44 (FIG. 5) and conduit 48*j* connects gap 49*k*, via port 45*c* to recirculation system 60 via port 45 (FIG. 5). Conduit 48*k* connects gap 49L, via port 46*c* to recirculation system 60 via port 46 (FIG. 5) and conduit 48L connects gap 49*j*, via port 47*c* to recirculation system 60 via port 47 (FIG. 5). Sensor 52 is connected to container 11 and sensor 52 is used to maintain a processing solution level 235 relative to conduit 51. Excess processing solution may be removed by overflow conduit 51.

Textured surface 200 or 205 is affixed to the surface of slot nozzles 17*g*, 17*h*, 17*i*, 17*j*, 17*k* and 17L that face processing channel 25.

FIG. 5 is a schematic drawing of processing solution recirculation system 60 of the apparatus of this invention. Module 10 is designed in a manner to minimize the volume of channel 25. The outlets 44, 45, 46 and 47 of module 10 are connected to recirculating pump 80 via conduit 85. Recirculating pump 80 is connected to manifold 64 via conduit 63 and manifold 64 is coupled to filter 65 via conduit 66. Filter 65 is connected to heat exchanger 86 and heat exchanger 86 is connected to channel 25 via conduit 4. Heat exchanger 86 is also connected to control logic 67 via wire 68. Control logic 67 is connected to heat exchanger 86 via wire 70 and sensor 52 is connected to control logic 67 via wire 71. Metering pumps 72, 73 and 74 are respectively connected to manifold 64 via conduits 75, 76 and 77.

The photographic processing chemicals that comprise the photographic solution are placed in metering pumps 72, 73 and 74. Pumps 72, 73 and 74 are used to place the correct amount of chemicals in manifold 64, When photosensitive material sensor 210 senses that material 21 (FIG. 1) is entering channel 25, sensor 210 transmits a signal to pumps 72, 73 and 74 via line 211 and control logic 67. Manifold 64 introduces the photographic processing solution into conduit 66.

The photographic processing solution flows into filter 65 via conduit 66. Filter 65 removes contaminants and debris that may be contained in the photographic processing solution. After the photographic processing solution has been filtered, the solution enters heat exchanger 86.

Sensor 52 senses the solution level and sensor 8 senses the temperature of the solution and respectively transmits the solution level and temperature of the solution to control logic 67 via wires 71 and 7. For example, control logic 67 is the series CN 310 solid state temperature controller manufactured by Omega Engineering, Inc. of 1 Omega Drive, Stamford, Conn. 06907. Logic 67 compares the solution temperature sensed by sensor 8 and the temperature that exchanger 86 transmitted to logic 67 via wire 70. Logic 67 will inform exchanger 86 to add or remove heat from the solution. Thus, logic 67 and heat exchanger 86 modify the temperature of the solution and maintain the solution temperature at the desired level.

Sensor 52 senses the solution level in channel 25 and transmits the sensed solution level to control logic 67 via wire 71. Logic 67 compares the solution level sensed by sensor 52 via wire 71 to the solution level set in logic 67. Logic 67 will inform pumps 72, 73 and 74 via wire 83 to add additional solution if the solution level is low. Once the solution level is at the desired set point control logic 67 will inform pumps 72, 73 and 74 to stop adding additional solution.

Any excess solution may either be pumped out of module 10 or removed through level drain overflow 84 via conduit 81 into container 82.

At this point the solution enters module 10 via inlets 41, 42 and 43. When module 10 contains too much solution the excess solution will be removed by overflow conduit 51, drain overflow 84 and conduit 81 and flow into reservoir 82. The solution level of reservoir 82 is monitored by sensor 212. Sensor 212 is connected to control logic 67 via line 213. When sensor 212 senses the presence of solution in reservoir 82, a signal is transmitted to logic 67 via line 213 and logic 67 enable pump 214. Thereupon pump 214 pumps solution into manifold 64. When sensor 212 does not sense the presence of solution, pump 214 is disabled by the signal transmitted via line 213 and logic 67. When solution in reservoir 82 reaches overflow 215, the solution will be transmitted through conduit 216 into reservoir 217. The remaining solution will circulate through channel 25 and reach outlet lines 44, 45, 46 and 47. Thereupon, the solution will pass from outlet lines 44, 45, 46 and 47 to conduit line 85 to recirculation pump 80. The photographic solution contained in the apparatus of this invention, when exposed to the photosensitive material, will reach a seasoned state more rapidly than prior art systems, because the volume of the photographic processing solution is less.

Figure 6:
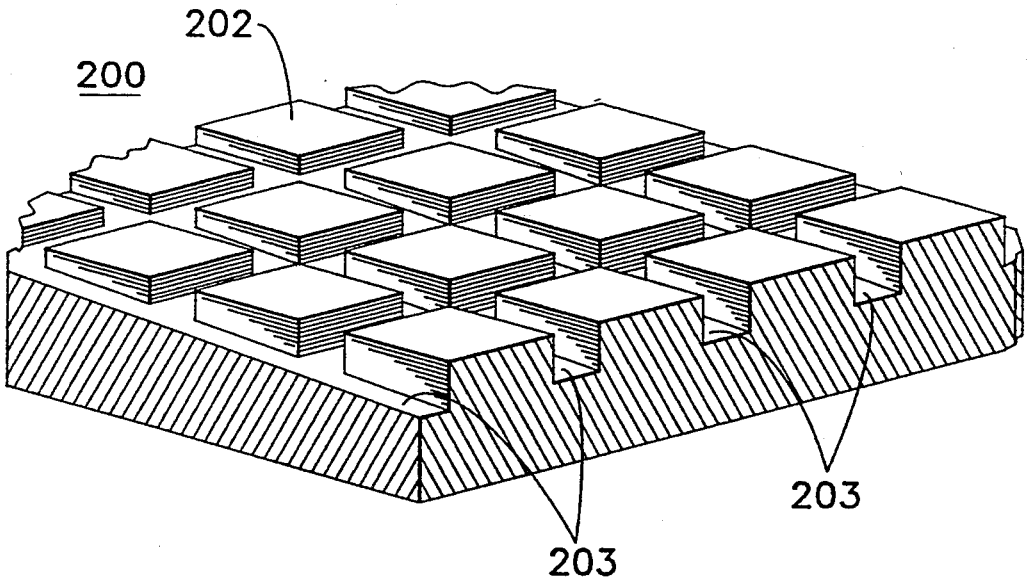
FIG. 6 is a perspective drawing of textured fluid bearing surface 200.

FIG. 6 is a perspective drawing of textured fluid-bearing surface 200 which is affixed to backing plate 9 and/or slot nozzles 17*a*–17L of FIG. 2. Textured surface 200 is textured by any known process, e.g., knurling, molded, EDM electro-discharged machined or applied. Knurls 202 are shown on surface 200. The texturing and cantering improve the flow of processing solution between photosensitive material 21 and backing plate 9 and/or slot nozzles 17*a*–17L. In addition to improving the flow of processing solution the texturing and cantering provide an improvement in the control over the direction of flow of the processing solution. This yields a bearing of fluid aiding photosensitive material transport through processing channel 25 and allows the gelatin on photosensitive material 21 to swell. It also allows for improved circulation of processing solution and makes it easier for contaminants and debris to escape direct and damaging contact with photosensitive material 21. Textured surface 200 and canted passageways 203 provide space between photosensitive material 21 and plates 9 and/or nozzles 17*a*–17L to prevent contaminants and debris from scratching, abrading or pressure sensitizing photosensitive material 21.

Figure 7:
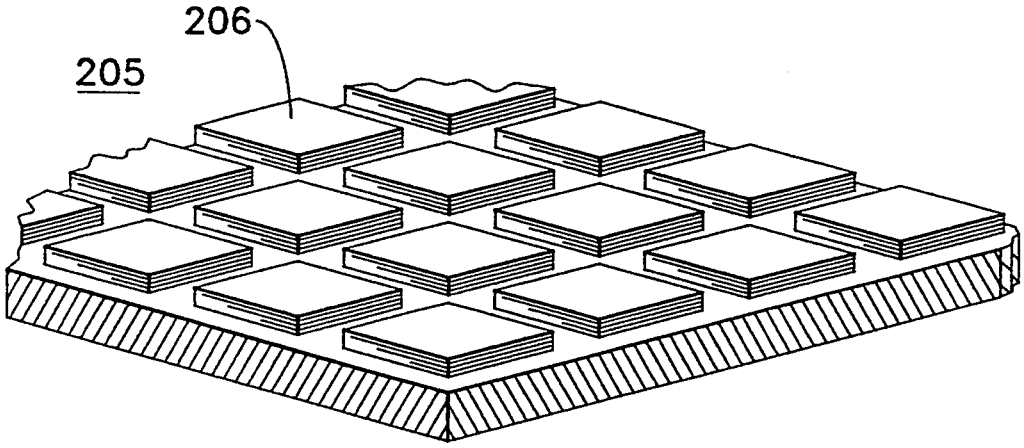
FIG. 7 is a perspective drawing of textured fluid bearing surface 205.

FIG. 7 is a perspective drawing of textured fluid-bearing surface 205 that is affixed to backing plate 9 and/or slot nozzles 17*a*–17L of FIG. 2. Textured surface 205 is textured by any known process, e.g., knurling, molded, EDM electro-discharged machined or applied. Knurls 206 are shown on surface 205. The texturing improves the flow of processing solution between photosensitive material 21 and backing plate 9 and/or slot nozzles 17*a*–17L. In addition to improving the flow of processing solution the texturing provides control over the direction of flow of the processing solution. This yields a bearing of fluid aiding photosensitive material transport through processing channel 25 and allows the gelatin on photosensitive material 21 to swell. It also allows for improved circulation of processing solution and makes it easier for contaminants and debris to escape direct and damaging contact with photosensitive material 21. Textured surface 205 provides space between photosensitive material 21 and plates 9 and/or nozzles 17*a*–17L to prevent contaminants and debris from scratching, abrading or pressure sensitizing photosensitive material 21.

The above specification describes a new and improved apparatus for processing photosensitive materials. It is realized that the above description may indicate to those skilled in the art additional ways in which the principles of this invention may be used without departing from the spirit. It is, therefore, intended that this invention be limited only by the scope of the appended claims.

Parts List

4 conduit
7 wire
8 sensor
9 backing plate
10 processing module
11 container
12 transport roller assembly
13 transport roller assembly
15 transport roller assembly
16 drive
17*a–l* nozzles
18 rotating assembly
20 cover
21 photosensitive material
22 roller
23 roller
24 channel section
25 channel
26 bearing bracket
28 intermeshing gears
30 roller
31 roller
32 roller
33 roller
41 port
41*a–c* inlet port
42 port
42*a–c* inlet port
43 port
43*a–c* inlet port
44 port
44*a–c* port
45 port
45*a–c* port
46 port
46*a–c* port
47 port
47*a–c* port
48*a–l* conduit
49*a–l* gap
50*a–l* conduit
51 overflow conduit
52 sensor
60 recirculation system
61 access hole
62 tension springs
63 conduit

64 manifold
65 filter
66 conduit
67 control logic
68 wire
70 wire
71 wire
80 recirculating pump
81 conduit
82 container
84 drain overflow
85 conduit
86 heat exchanger
100 entrance channel
101 exit channel
130 roller
131 roller
200 textured surface
202 knurls
203 passageways
205 textured surface
206 knurls
210 sensor
211 line
212 sensor
213 line
214 pump
215 overflow
216 conduit
217 reservoir
235 solution level

What is claimed is:

1. An apparatus for processing photosensitive materials, said apparatus comprising:

a processing module comprising a container, at least one processing assembly placed in said container and at least one transport assembly disposed adjacent said at least one processing assembly, said at least one processing assembly and said at least one transport assembly forming a substantially continuous channel through which a processing solution flows, said at least one processing assembly and said at least one transport assembly substantially filling said container and being relatively dimensioned so that a small volume is provided for holding and moving processing solution and photosensitive material through said processing module, at least one discharge opening is provided in said at least one transport assembly or said at least one processing assembly for introducing processing solution to said channel, said channel having at least one surface which is textured so as to facilitate transport of the photosensitive material and processing solution through said channel; and means for circulating the processing solution from said small volume provided in said module directly to said at least one discharge opening.

2. The apparatus claimed in claim 1, further including:

at least a first and a second slot nozzle coupled to said circulating means and forming a portion of said channel for controlling the velocity and amount of processing solution that dynamically impinges on the surface of the photosensitive material;

a first conduit that is connected to one end of said first slot nozzle and said circulating means so that processing solution may travel in said first slot nozzle in a first direction; and a second conduit that is connected to the other end of said second slot nozzle and said circulation means so that processing solution may travel in said second slot nozzle in a second direction.

3. The apparatus claimed in claim 1, wherein the inner textured surfaces of said channel are canted to allow the processing solution to travel in a different direction than the photosensitive material.

4. The apparatus claimed in claim 1, wherein the inner textured surfaces of said channel are canted to allow the removal of processing contaminants and debris.

5. The apparatus claimed in claim 1, wherein said circulation means comprises:

a pump for recirculating the processing solution; and a filter connected to said first and second conduit for removing contaminants from the processing solution, wherein the processing solution volume contained in said pump, said first and second conduits and said filter does not exceed the small volume for holding processing solution.

6. The apparatus claimed in claim 5, further including a heat exchanger that rapidly regulates the temperature of the processing solution.

7. The apparatus claimed in claim 6, further including:

a plurality of metering pumps for metering specified amounts of chemicals; and a manifold coupled to said first and second conduit and said metering pumps for dispensing additional processing solution to the small volume.

8. The apparatus claimed in claim 7, wherein said containers have an overflow conduit coupled to a reservoir to maintain a consistent processing solution level.

9. An apparatus for processing photosensitive materials, said apparatus comprising:

a processing module comprising a container and at least one processing assembly placed in said container, said at least one processing assembly forming a channel through which a processing solution flows, said channel having an entrance and an exit, said channel having at least one surface which is textured to as to facilitate transport of the photosensitive material and processing solution through said channel;

transport means for transporting the photosensitive material from the channel entrance through said channel to the channel exit, said transport means being disposed adjacent said at least one processing assembly and forming a portion of said channel, said container, said transport means and said at least one processing assembly are relatively dimensioned so that a small volume is provided for holding and moving processing solution and photosensitive material through said processing module; and means for circulating the processing solution through the small volume provided in said processing module.

10. An apparatus for processing photosensitive materials, said apparatus comprising:

a processing module comprising a container, at least one processing assembly placed in said container and at least one transport assembly disposed adjacent said at least one processing assembly, said at least one processing assembly and said at least one transport assembly forming a substantially continuous channel through which a processing solution flows, said at least one processing assembly and said at least one transport assembly substantially filling said container and being relatively dimensioned so that a small volume is provided for holding and moving processing solution and photosensitive material through said processing module, wherein said channel having at least one surface which is textured so as to facilitate transport of the photosensitive material and processing solution through said channel; and means for circulating the processing solution through the small volume provided in said module.

11. An apparatus for processing photosensitive materials, said apparatus comprising:

a processing module comprising a container and at least one processing assembly placed in said container, said container and said at least one processing assembly forming a channel through which a processing solution flows, said channel having an entrance and an exit, said channel having at least one surface which is textured so as to facilitate transport of the photosensitive material and processing solution through the channel, said at least one processing assembly having a discharge opening for delivering processing solution to said channel, said at least one processing assembly and container are relatively dimensioned so that a small volume is provided for holding and moving processing solution and photosensitive material through said processing module; and means for circulating the processing solution directly from said small volume provided in said processing module to said discharge opening.

12. An apparatus according to claim 11 further comprising means coupled to said at least one processing assembly for transporting the photosensitive material from the channel entrance through said channel to the channel exit.

* * * * *